US011565877B2

(12) United States Patent
Pope et al.

(10) Patent No.: US 11,565,877 B2
(45) Date of Patent: Jan. 31, 2023

(54) CONTAINER CLOSURE NODE SYSTEM

(71) Applicant: In-Tech Enterprise Ltd., Kowloon (HK)

(72) Inventors: Gordon Christopher Pope, The Peak (HK); Mak Tse, Yuen Long (HK); Dejin Liu, Shenzhen (CN); Xiongbo Huang, Shenzhen (CN); Cheuk Kuen Chim, Shatin (HK); Man Wai Ho, Tuen Mun (HK); Jacky Sai Ping Tsang, Shatin (HK)

(73) Assignee: IN-TECH ENTERPRISE LTD., Kowloon (HK)

( * ) Notice: Subject to any disclaimer, the term of this patent is extended or adjusted under 35 U.S.C. 154(b) by 99 days.

(21) Appl. No.: 17/021,140

(22) Filed: Sep. 15, 2020

(65) Prior Publication Data

US 2022/0081203 A1 Mar. 17, 2022

(51) Int. Cl.

| | |
|---|---|
| ***B65D 90/48*** | (2006.01) |
| ***B65D 90/54*** | (2006.01) |
| ***G08B 21/18*** | (2006.01) |

(52) U.S. Cl.

CPC ..... *B65D 90/48* (2013.01); *B65D 90/54* (2013.01); *G08B 21/18* (2013.01); *B65D 2590/0083* (2013.01); *B65D 2590/54* (2013.01)

(58) Field of Classification Search

CPC B65D 90/48; B65D 90/54; B65D 2590/0083; B65D 2590/54; G08B 21/18

See application file for complete search history.

(56) References Cited

U.S. PATENT DOCUMENTS

2010/0117797 A1* 5/2010 Bauchot ..... H04Q 9/00 220/212
2015/0096269 A1* 4/2015 Tenegal ..... B65D 90/545 53/473

(Continued)

FOREIGN PATENT DOCUMENTS

CN 106 080 175 11/2016
CN 106080175 A * 11/2016 ..... B60K 15/0409

(Continued)

OTHER PUBLICATIONS

Extended Search Report, European Patent Application No. 21150791.8, 9 pages.

*Primary Examiner* — Mohamed Barakat
(74) *Attorney, Agent, or Firm* — Haynes and Boone, LLP

(57) ABSTRACT

A container closure node system includes a closure chassis coupling device that couples to a container closure for a container aperture. The closure chassis coupling device includes a first plate member that includes a first securing element and a second securing element. The closure chassis coupling device also includes a second plate member that includes a third securing element that is configured to couple to the first securing element and a fourth securing element that is configured to couple to the second securing element. At least one of the first plate member and the second plate member includes a container closure engagement member that is configured to engage the container closure to prevent rotational movement of the closure chassis coupling device relative to the container closure when the third securing element is coupled with the first securing element and the fourth securing element is coupled with the second securing element.

19 Claims, 11 Drawing Sheets

(56) References Cited

U.S. PATENT DOCUMENTS

| | | | | |
|---|---|---|---|---|
| 2016/0185588 | A1* | 6/2016 | Huber | B67D 7/0288<br>285/124.1 |
| 2016/0362071 | A1* | 12/2016 | Roll | B60R 13/0243 |
| 2018/0345721 | A1* | 12/2018 | Letscher | B62D 49/0621 |
| 2020/0255217 | A1* | 8/2020 | Boecker | G01F 23/38 |

FOREIGN PATENT DOCUMENTS

| | | |
|---|---|---|
| FR | 2 732 700 | 3/2000 |
| GB | 2 494 646 | 3/2013 |

* cited by examiner

CONTAINER CLOSURE NODE SYSTEM

CROSS REFERENCE TO RELATED APPLICATIONS

This application is related to U.S. Utility application Ser. No. 17/021,214, filed Sep. 15, 2020, the disclosure of which is incorporated herein by reference in its entirety.

FIELD OF THE DISCLOSURE

This disclosure relates generally to containers, and, more particularly, to closure security systems for containers.

BACKGROUND

Containers may be used for storage, shipping, and packaging of a variety of products. For example, intermediate bulk containers (IBCs), drums, barrels, bottles, and/or other containers are designed for the transport and storage of bulk liquid and granulated substances such as chemicals, food ingredients, solvents, pharmaceuticals, hazardous materials, and/or a variety of other goods and products known in the art. Containers typically provide one or more openings that allow access to the containers through which the container may be filled with the product, and/or through which the product may be dispensed from the container. During shipment and storage, these openings may be obstructed with a variety of closures such as, for example, caps, plugs, tops, valves, lids, and other closures. These closures provide many benefits for the container and the product being shipped and/or stored within the container such as, for example, preventing the product within the container from escaping, preventing materials from outside of the container from entering the container and contaminating the product, preventing spoilage, as well as other uses that would be apparent to one of skill in the art.

Conventional closures attempt to provide container security by including seals that, when broken, indicate whether the container has been opened, prior to, or subsequent to filling the container with the product. Due to the nature of some products being shipped in containers, seals may be important for tracking and determining whether the product within the container has been tampered with (e.g., lost, stolen, and/or contaminated) and/or accessed for legitimate purposes. For example, high value liquids used in agrochemical industries may be stolen and/or replaced with counterfeit products, and products used in food industry may require integrity and/or traceability. Such conventional container security systems provide the ability to detect whether the container has experienced tampering by visual inspection of the seal. However, these conventional container security systems are subject to circumvention. For example, the seal may be broken, the closure removed, the product in the container replaced, diluted, or stolen (e.g., during shipment), and the closure and the seal then duplicated and replaced on the container such that the tampering with the product goes undetected.

SUMMARY

According to one embodiment, a container system, includes a container that includes a container chassis that defines a container volume and a first aperture; a container closure coupled to the container chassis, and that includes a closure chassis that is configured, when coupled to the container chassis, to prevent movement of a material between the container volume and an exterior of the container chassis via the first aperture; and a container closure node system, wherein the container closure node system includes: a closure chassis coupling device that couples the container closure node system to the closure chassis and that includes: a first plate member that includes a first plate securing element and a second plate securing element; and a second plate member that includes a third plate securing element that is coupled to the first plate securing element and a fourth plate securing element that is coupled to the second plate securing element, wherein at least one of the first plate member and the second plate member is configured to engage the closure chassis to prevent rotational movement of the closure chassis coupling device relative to the closure chassis when the first plate securing element is coupled with the third plate securing element and the second plate securing element is coupled with the fourth plate securing element.

According to another embodiment, a container closure node system includes: a closure chassis coupling device that is configured to couple to a closure chassis for a container aperture and that includes: a first plate member that includes a first plate securing element and a second plate securing element; and a second plate member that includes a third plate securing element that is configured to couple to the first plate securing element and a fourth plate securing element that is configured to couple to the second plate securing element, wherein at least one of the first plate member and the second plate member is configured to engage the closure chassis to prevent rotational movement of the closure chassis coupling device relative to the closure chassis when the first plate securing element is coupled with the third plate securing element and the second plate securing element is coupled with the fourth plate securing element.

According to yet another embodiment, a method of coupling a container closure node system to a container closure, includes: positioning a container closure coupling device around a container closure; engaging a first securing element engagement member included on a first plate member of the container closure coupling device with a second securing element engagement member included on a second plate member of the container closure coupling device such that a container closure chassis securing element on at least one of the first plate member and the second plate member couples the container closure coupling device to the container closure; and preventing, by the container closure chassis securing element, rotational movement of the closure chassis coupling device relative to the container closure.

Figure 1A:
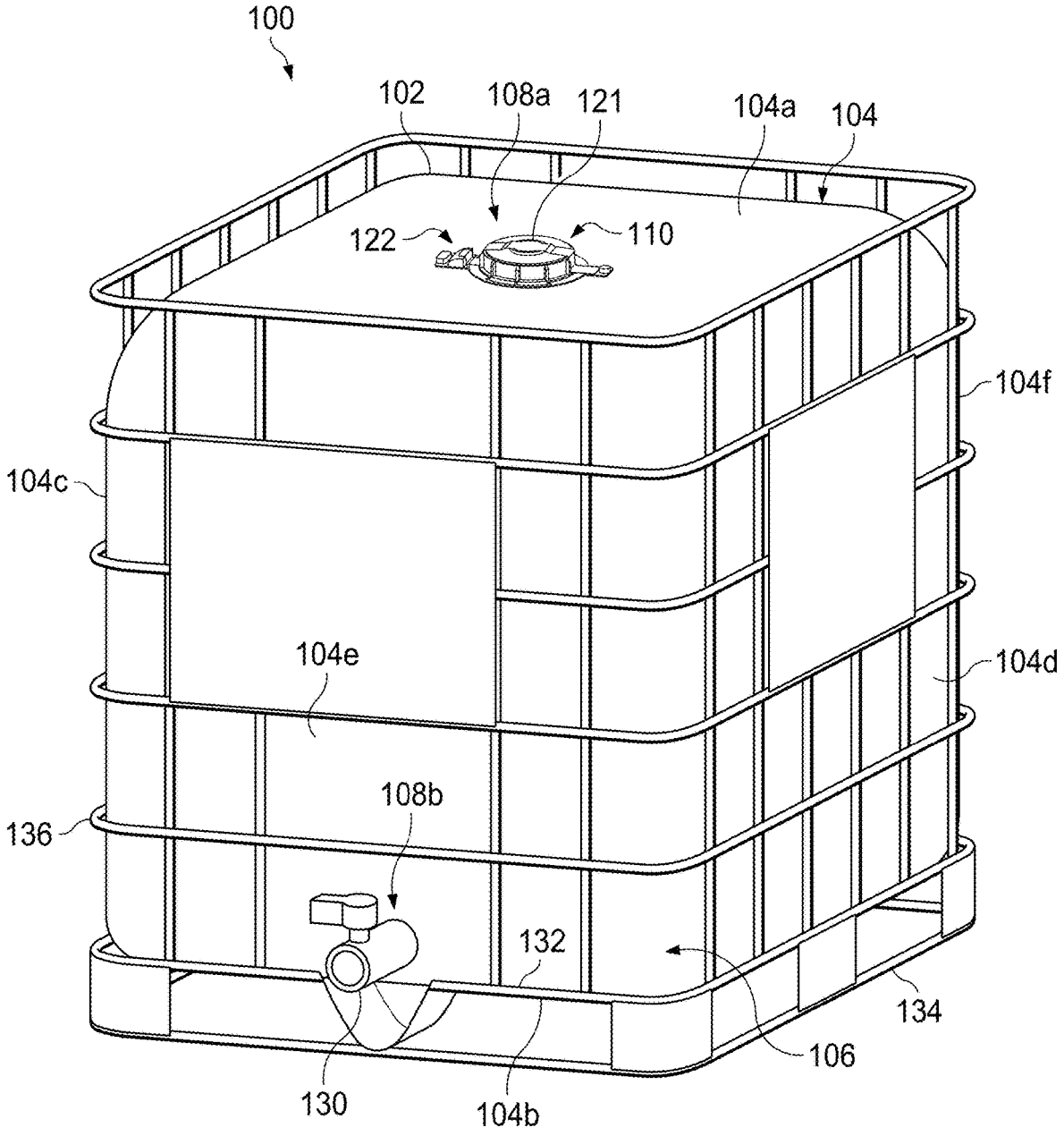
FIG. 1A is a perspective view illustrating an embodiment of a container system.

Embodiments of the present disclosure may be understood by referring to the detailed description that follows. It should be appreciated that like reference numerals are used to identify like elements illustrated in one or more of the figures, wherein showings therein are for purposes of illustrating embodiments of the present disclosure and not for purposes of limiting the same.

DETAILED DESCRIPTION

Embodiments of the present disclosure include a container closure node system, as well as methods for coupling the container closure node system to a container closure and providing container security that may be used to track access to a container. As discussed above, existing seals and closures for containers do not prevent tampering with the containers and products provided within those containers, as it has been found that the conventional closures and seals are easily reproduced and replaced on tampered-with containers such that it is difficult for legitimate parties (e.g., a container manufacturer, a container filler, a container transporter, a container end user, and other parties) associated with the container to detect tampering with the closure and/or seal. Furthermore, some industries may require that access to the container volume be tracked during the lifecycle of the container and conventional seals and closures lack tracking capabilities. Further still, containers, such as intermediate bulk containers (IBCs), are often standardized and include standard components such as closures and valves that allow end users to quickly fill, empty, and/or clean the IBC according to the particular material held within the container using specifically designed tools for the standard components. For example, spanners may be used to open container closures and cleaning tools may access the container volume via the container closures.

As would be appreciated to one of skilled in the art, IBCs typically go through a specific container lifecycle where the IBC is manufactured on a highly organized assembly line, shipped to a customer that fills the IBC with a material, shipped to an end user that empties the material out of the IBC, and returned to the manufacturer for reconditioning, which includes breaking down the IBC into various components for reuse and recycling. Thus, when adding an optional closure security system, such as those developed by some of the inventors of the present disclosure, and that are described in the U.S. Pat. No. 10,538,371 and that are described in U.S. patent application Ser. No. 16/451,879, filed on Jun. 25, 2019, entitled "Container Security System," the disclosures of which are incorporated by reference herein in their entirety and that provides for the detection of whether a container closure and/or a container has experienced a tamper event, these manufacturing and tooling requirements must be taken into consideration so as to not unduly disrupt the IBC lifecycle.

In various embodiments of the present disclosure, a container closure node system is disclosed. The container closure node system includes a closure chassis coupling device that couples the container closure node system to a container closure used to close a container opening in a container, (e.g., an IBC). In a specific example illustrated and discussed in the present disclosure, the container closure may be an IBC's top cap. However, one of skill in the art in possession of the present disclosure will recognize that other container closures will benefit from the teachings of the present disclosure. The closure chassis coupling device may include a first plate member and a second plate member that when coupled together and engaged with the container closure prevent rotational movement of closure chassis coupling device and the container closure node system relative to the container closure. However, in other embodiments, the closure chassis coupling device may include one or more plate members. In other words, if the container closure that is often screwed onto the container is turned, the container closure node system will turn with the container closure or vice versa. The first plate member and the second plate member, when coupled together and engaged with the container closure, may also prevent or provide resistance to other directional movement of closure chassis coupling device and the container closure node system relative to the container closure as well. Each end of the first plate member may include a plate securing element that is configured to couple with a corresponding plate securing element on each end of the second plate member. In an embodiment, a first set of corresponding plate securing elements on the first plate member and the second plate member may be pivotally coupled to each other. A second set of corresponding plate securing elements on the first plate and the second plate may include a plate securing element release member such that the second set of corresponding securing elements can decouple when the plate securing element release member is activated. Those ends of the first plate member and the second plate member having the second set of corresponding securing elements may be rotationally separated via the rotation of the first plate member and second plate member about the pivot point provided by the first set of corresponding plate securing elements.

In various embodiments, the container closure may define a closure chassis aperture that provides access to the opening in the container without having to remove the container closure. A secondary container closure may be coupled to the closure chassis aperture to prevent the movement of material into or out of the container via the closure chassis aperture. Users may use this closure chassis aperture to move materials into and/or out of the container, which requires standardized tools that conform to the closure chassis aperture and/or the container closure. At the very least, relative easy access to the secondary container closure and/or the closure chassis aperture may be required during the container lifecycle. As such, the closure chassis coupling device defines a closure chassis coupling device aperture that provides access to the closure chassis aperture when the closure chassis coupling device couples the container closure node system to the container closure. In various embodiments, spanner devices that conform to the shape of the closure chassis side walls are used to remove the container closure from the container. As such, the closure chassis coupling device defines the closure chassis coupling device aperture to provide access to at least a portion of a closure chassis side wall and the first plate member and the second plate member have a height profile that is less than a height of the container closure.

The container closure node system may also include a node device that may include some or all of the components of the container security system discussed above. The node device may be coupled to the first plate member and/or the second plate member via a node securing element. In some embodiments, the node device may be detachable from the first plate member and/or the second plate member and may extend from the first plate member and/or the second plate member such that the first plate member and/or the second plate member and the node device, when the node device is coupled to the closure chassis coupling, define a gap between the node device and the closure chassis side wall included on the container closure. The gap may be optimized such that the spanner device can fit between the node device and the closure chassis side wall.

In various embodiments, the node device includes a power source, at least one sensor, a communication system, and a processing system. The at node device may also include a memory system that is coupled to the processing system and that includes instruction, that when executed by the processing system, causes the processing system to provide a node security engine that detects, via the at least one sensor, that a security event has occurred and provides, via the communication system, a security event notification for the detected security event. For example, one of the sensors may be a Hall effect sensor and a magnet may be attached to the container such that the magnet and Hall effect sensor are aligned when the closure chassis coupling device couples the container closure node system to the closure chassis. Thus, if the container closure is moved or the container closure node system is removed from the container closure, such that the Hall effect sensor is moved relative to the magnet on the container, a security event may be detected and reported via the communication system.

In various embodiments, the container closure node system may include a seal that covers at least a portion of the container closure and/or a portion of the closure chassis aperture. The seal may couple to at least a seal presence sensor included on the node device that detects the presence of the seal and/or lack of presence of the seal covering at least the portion of the container closure and/or the portion of the closure chassis aperture. The seal may conform to the shape of the container closure, the node device, and the closure chassis coupling device and be adhered or otherwise fastened to the container closure, the node device, and/or the closure chassis coupling device. The seal may also include a communication interface such as a Near Field Communication (NFC) interface or a Radio Frequency Identifier (RFID) interface that stores and communicates a seal identifier associated with the seal, the container closure, the container, and/or the container closure node system or components thereof. As such, the container closure node system of the present disclosure may provide relative easy and quick attachment and detachment of the container closure node system and a node device that provides security to a container closure without disrupting a conventional container lifecycle and allow for conventional tools to access the container closure.

Figure 1B:
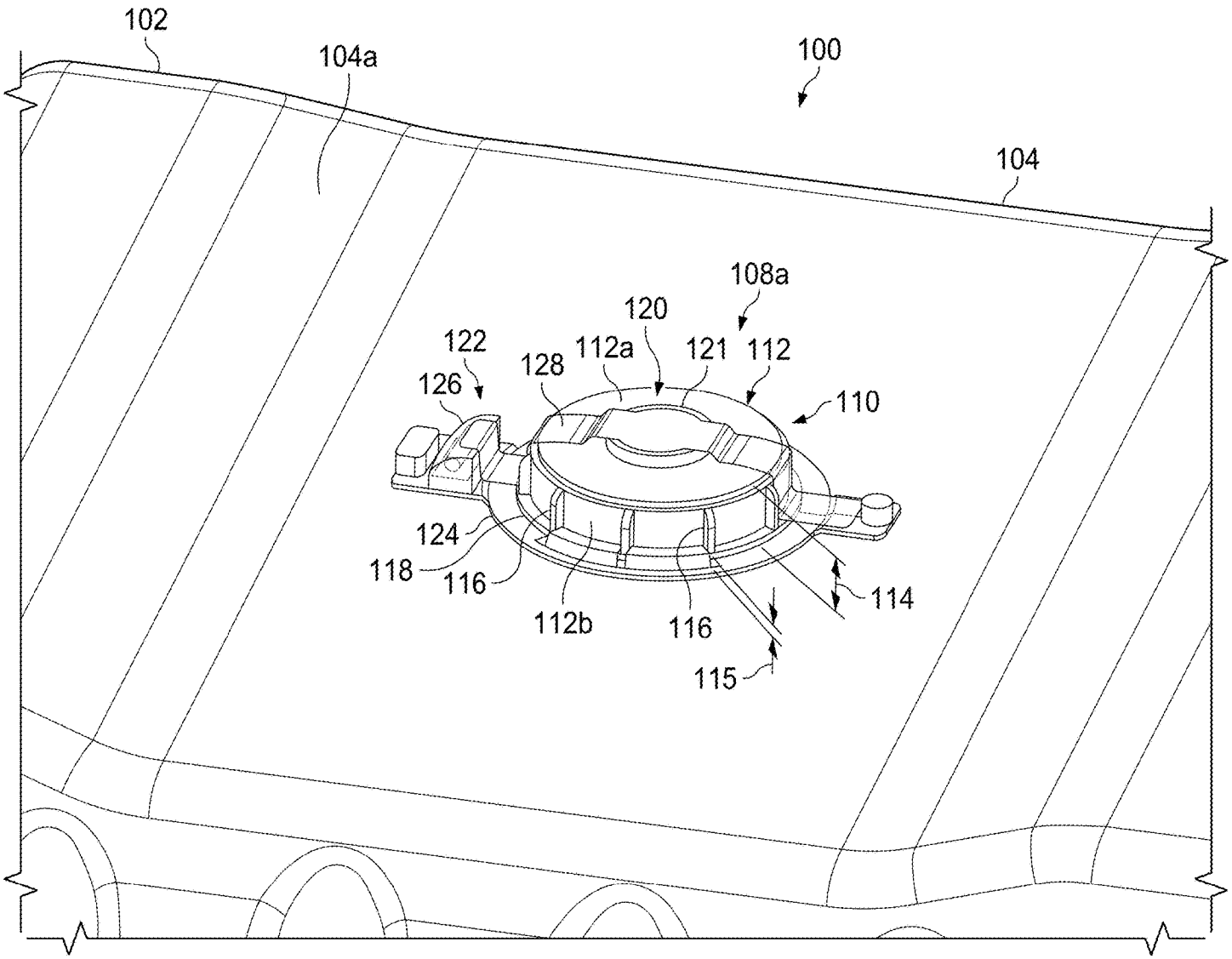
FIG. 1B is a perspective view illustrating an embodiment of a top wall of a container included in the container system that includes a container closure and a container closure node system.

Referring now to FIGS. 1A and 1B, various embodiments of a container system 100 are illustrated. The container system 100 includes a container 102 having container chassis 104 that includes a top wall 104*a*, a bottom wall 104*b* that is located opposite the container chassis 104 from the top wall 104*a*, and a pair of side walls 104*c* and 104*d* that are located opposite the container chassis 104 from each other and that extend between the top wall 104*a* and the bottom wall 104*b*. The container chassis 104 may include a front wall 104*e* that extends between the top wall 104*a*, the bottom wall 104*b*, and the side walls 104*c* and 104*d*, and a rear wall 104*f* that that is located opposite the container chassis 104 from the front wall 104*e* and that extends between the top wall 104*a*, the bottom wall 104*b*, and the side walls 104*c* and 104*d*. A container volume 106 is defined by the container chassis 104 by the top wall 104*a*, the bottom wall 104*b*, the side walls 104*c* and 104*d*, the front wall 104*e*, and the rear wall 104*f*. In the illustrated embodiment, the top wall 104*a* defines a container aperture 108*a* and the front wall 104*e* and defines a container aperture 108*b* that is located adjacent the bottom wall 104*b* such that a fluid or other material may flow out of the container aperture with the aid of gravity. While a specific example of the container 102 is illustrated and described below (e.g., an IBC), one of skill in the art will recognize that the teachings of the present disclosure will be beneficial to container systems including a variety of containers and/or other container apertures that may be on any of the walls 104*a*-104*f* known in the art, and thus systems including those containers will fall within the scope of the present disclosure as well.

In various embodiments, the container system 100 includes a container closure 110 having a container closure chassis 112 that includes a container closure chassis top wall 112*a* and one or more container closure chassis side walls 112*b* that extend from the container closure chassis top wall 112*a*. As illustrated in FIGS. 1A and 1B, the container closure chassis 112 includes the container closure chassis top wall 112*a* that is circular in shape and the container closure chassis side wall 112*b* extends from a first surface of the container closure chassis top wall 112*a* at a height 114 and spans a circumference of the container closure chassis top wall 112*a*. The top wall 104*a* of the container 102 and the container closure chassis 112 may define a space 115 when the container closure 110 is coupled to the container 102. In various embodiments, one or more protrusions 116 may extend from a first surface of the container closure chassis side wall 112*b* and may operate as gripping elements. While not illustrated, the container closure chassis side wall 112*b* may include one or more container chassis securing elements (e.g., frictional securing element, a screw thread, a plug etc.) that are configured to couple the container closure chassis 112 to the container chassis 104 and that are located on a second surface of the container closure chassis side wall 112*b* that is opposite the container closure chassis side wall 112*b* from the first surface.

In various embodiments, the container closure chassis side wall 112*b* may include a closure lip 118 on an edge of the container closure chassis side wall 112*b* that is opposite the container closure chassis side wall 112*b* from an edge that is connected to the container closure chassis top wall 112*a*. The closure lip 118 may extend from at least one of the first surface or the second surface of the container closure chassis side wall 112*b* around the circumference of the container closure chassis side wall 112*b*. In various embodiments, the container closure chassis top wall 112*a* may define a container closure chassis aperture 120 that provides access to the container aperture 108*a*. A secondary container closure 121 may be coupled to the container closure chassis 112 to prevent movement of materials or substances to or from the container volume 106 via the container closure chassis aperture 120. While a specific example of a container closure 110 is illustrated and described below, one of skill in the art will recognize that the teachings of the present disclosure will be beneficial to other container closures known in the art, and thus systems including those containers closures will fall within the scope of the present disclosure as well.

In various embodiments, the container system 100 may include a container closure node system 122. The container closure node system 122 may include a closure chassis coupling device 124 that is configured to couple the container closure node system 122 to the container closure 110. The container closure node system 122 may include a node device 126 that is coupled to the closure chassis coupling device 124. In various embodiments, the container closure node system 122 may include a seal 128 that is coupled to the container closure 110 and at least the node device 126. The details of the container closure node system 122 are described in further detail below.

In various embodiments, the container system 100 may include a container closure 130. The container closure 130 may be coupled to the container aperture 108*b* and configured to prevent or permit the movement of material to or from the container volume 106. In the illustrated example, the container closure 130 may include a valve. In various embodiments, the container closure 130 may include a container module that includes a processing system, a memory system, a short-range communication interface, and a long-range communication interface and that is described in the U.S. Pat. No. 10,538,371 and that are described in U.S. patent application Ser. No. 16/451,879, filed on Jun. 25, 2019, entitled "Container Security System," the disclosures of which are incorporated by reference herein in their entirety. In various embodiments, the container closure may include a container value node system that is coupled to the container closure 130 and that is described in U.S. patent application Ser. No. 17/021,214, filed on Sep. 15, 2020 along with the present disclosure. While a specific container closure 130 is illustrated, one or skill in the art in possession of the present disclosure will recognize that other container closures may be provided that may benefit from the teachings of the present disclosure.

In various embodiments, the container system 100 may also include a cage system 132 that is configured to house the container 102. The cage system 132 may include a pallet base 134 coupled to a cage 136. While a specific container system 100 has been illustrated and described, one of skill in the art in possession of the present disclosure will recognize that the container system 100 of the present disclosure may include a variety of components and component configurations while remaining within the scope of the present disclosure as well.

Figure 2:
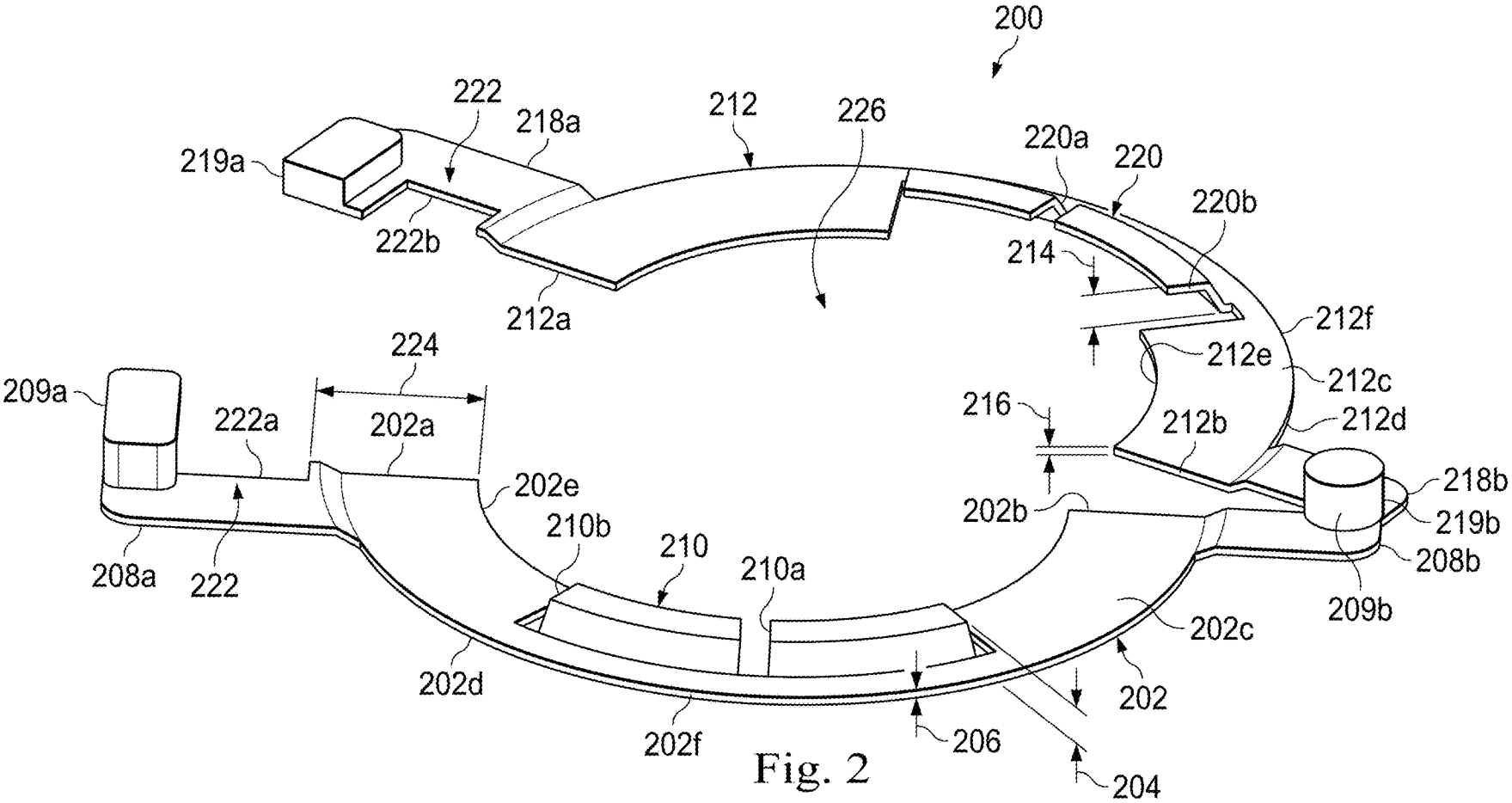
FIG. 2 is a perspective view illustrating an embodiment of a closure chassis coupling device included in the container closure node system of FIGS. 1A and 1B.

Referring now to FIG. 2, an embodiment of a closure chassis coupling device 200 is illustrated that may provide the closure chassis coupling device 124 included in the container closure node system 122 discussed above with reference to FIG. 1. The closure chassis coupling device 200 may include a first plate member 202. The first plate member 202 may include a first end 202*a* and a second end 202*b* that is opposite the first plate member 202 from the first end 202*a*. The first plate member 202 may also include a first surface 202*c* and a second surface 202*d* that is opposite the first plate member 202 from the first surface 202*c*, and the first surface 202*c* and the second surface 202*d* extend between the first end 202*a* and the second end 202*b*. The first plate member 202 may also include a first edge 202*e* that extends between the first end 202*a*, the second end 202*b* and the first surface 202*c* and the second surface 202*d*, and a second edge 202*f* that is opposite the first plate member 202 from the first edge 202*e* that extends between the first end 202*a*, the second end 202*b*, and the first surface 202*c* and the second surface 202*d*. The first plate member 202 may have a height 204 that may be less than the height 114 of the container closure 110 and a portion of the first edge 202*e* may have a height 206 that is less than the space 115 between the container closure 110 and the top wall 104*a* of the container chassis 104 as illustrated in FIG. 1.

The first plate member 202 may include a plate securing element 208*a* that is coupled to the first end 202*a* of the first plate member 202 and a plate securing element 208*b* that is coupled to the second end 202*b* of the first plate member 202. The first plate member 202 may also include a container closure chassis securing element 210 that is configured to secure the closure chassis coupling device 200 to the container closure 110 of FIG. 1. For example, the container closure chassis securing element 210 may define one or more slots 210*a* that are configured to receive one or more of the protrusions 116 included on the container closure 110 of FIG. 1. The container closure chassis securing element 210 and the first surface 202*c* may define a closure lip slot 210*b* that is configured to receive the closure lip 118 included on the container closure 110 of FIG. 1.

The closure chassis coupling device 200 may include a second plate member 212. The second plate member 212 may include a first end 212*a* and a second end 212*b* that is opposite the second plate member 212 from the first end 212*a*. The second plate member 212 may also include a first surface 212*c* and a second surface 212*d* that is opposite the second plate member 212 from the first surface 212*c*, and the first surface 212*c* and the second surface 212*d* extend between the first end 212*a* and the second end 212*b*. The second plate member 212 may also include a first edge 212*e* that extends between the first end 212*a*, the second end 212*b*, and the first surface 212*c* and the second surface 212*d*, and a second edge 212*f* that is opposite the second plate member 212 from the first edge 212*e* that extends between the first end 212*a*, the second end 212*b*, and the first surface 212*c* and the second surface 212*d*. The second plate member 212 may have a height 214 that may be less than the height 114 of the container closure 110 and a portion of the first edge 212*e* may have a height 216 that is less than the space 115 between the container closure 110 and the top wall 104*a* of the container chassis 104 as illustrated in FIG. 1.

The second plate member 212 may include a plate securing element 218*a* that may be coupled to the first end 212*a* of the second plate member 212 and a plate securing element 218*b* that may be coupled to the second end 212*b* of the second plate member 212. The second plate member 212 may also include a container closure chassis securing element 220 that is configured to secure the closure chassis coupling device 200 to the container closure 110 of FIG. 1. For example, the container closure chassis securing element 220 may define one or more slots 220*a* that are configured to receive one or more of the protrusions 116 included on the container closure 110 of FIG. 1. The container closure chassis securing element 220 and the first surface 212*c* may define a closure lip slot 220*b* that is configured to receive the closure lip 118 included on the container closure 110 of FIG. 1.

In various embodiments, the plate securing element 208*a* of the first plate member 202 may be engaged with the plate securing element 218*a* of the second plate member 212. In an embodiment, the plate securing element 208*a* may include a securing element engagement member 209*a* that engages a corresponding securing element engagement member 219*a* on the plate securing element 218*a*. The securing element engagement member 209*a* and the securing element engagement member 219*a* may be frictionally coupled such that once a force threshold is applied that is opposite a force used for the engagement, the securing element engagement member 209*a* and the securing element engagement member 219*a* will become disengaged. However, in other examples, the engagement of the securing element engagement member 209*a* and the securing element engagement member 219*a* may lock the securing element engagement member 209*a* and the securing element engagement member 219*a*, such that the closure chassis coupling device 200 has to be destroyed to disengage the securing element engagement member 209*a* and the securing element engagement member 219*a*. In other examples, engagement of the securing element engagement member 209*a* and the securing element engagement member 219*a* may temporarily lock the securing element engagement member 209*a* and the securing element engagement member 219*a*. A securing element release member (not illustrated) may be included in at least one of the plate securing element 208*a* and the plate securing element 218*a* to disengage the securing element engagement member 209*a* and the securing element engagement member 219*a*.

In various embodiments, the plate securing element 208*b* of the first plate member 202 may be engaged with the plate securing element 218*b* of the second plate member 212. In an embodiment, the plate securing element 208*b* may include a securing element engagement member 209*b* that engages a corresponding securing element engagement member 219*b* on the plate securing element 218*b*. The securing element engagement member 209*b* and the securing element engagement member 219*b* may be frictionally coupled such that once a force threshold is applied that is opposite a force used for the engagement, the securing element engagement member 209*b* and the securing element engagement member 219*b* will become disengaged. However, in other examples, the engagement of the securing element engagement member 209*b* and the securing element engagement member 219*b* may lock the securing element engagement member 209*b* and the securing element engagement member 219*b*, such that the plate securing element 208*b* and/or the plate securing element 218*b* has to be destroyed to disengage the securing element engagement member 209*b* and the securing element engagement member 219*b*. In other examples, engagement of the securing element engagement member 209*b* and the securing element engagement member 219*b* may temporarily lock the securing element engagement member 209*b* and the securing element engagement member 219*b*. A securing element release member (not illustrated) may be included on at least one of the plate securing element 208*b* and the plate securing element 218*b* to disengage the securing element engagement member 209*b* from the securing element engagement member 219*b*.

As illustrated in FIG. 2, the securing element engagement member 209*b* and the securing element engagement member 219*b*, when engaged, may be pivotally coupled (e.g., form a hinge) such that the closure chassis coupling device 200 may be in a closed orientation when the securing element engagement member 209*a* and the securing element engagement member 219*a* are also engaged, or the closure chassis coupling device 200 may be in an open orientation when the securing element engagement member 209*a* and the securing element engagement member 219*a* are disengaged. When in a closed orientation, the first edge 202*e* of the first plate member 202 and the first edge 212*e* of the second plate member 212 may define a closure chassis coupling device aperture 226 that provides access to the container closure chassis aperture 120 and/or the container closure chassis side walls 112*b* of the container closure 110 illustrated in FIG. 1 when the closure chassis coupling device 200 couples the container closure node system 122 to the container closure 110.

In various embodiments, the closure chassis coupling device 200 may include a node securing element 222. The node securing element 222 may be configured to engage and couple the node device 126 of FIG. 1 to the closure chassis coupling device 200. For example, the node securing element 222 may be configured to engage and secure the node device 126 to the first plate member 202 and/or the second plate member 212. In the illustrated embodiment of FIG. 2, the node securing element 222 is provided by the plate securing element 208*a* and the plate securing element 218*b*. The plate securing element 208*a* may include a node securing element engagement member 222*a* and the plate securing element 218*a* may include a node securing element engagement member 222*b*. The node securing element engagement member 222*a* and the node securing element engagement member 222*b* may engage the node device 126 when the plate securing elements 208*a* and 218*a* are engaged and the plate securing elements 208*b* and 218*b* are engaged. In various embodiments, the node securing element 222 may extend from the second edge 202*f* of the first plate member 202 and/or the second edge 212*f* of the second plate member such that a spacing 224 is maintained between the first edge 202*e* and/or 212*e* and a node device 126 that is coupled to the node securing element 222 such that the spacing 224 is at least the width of a conventional spanner device when the closure chassis coupling device 200 is coupled to the container closure 110.

While two plate members (e.g., the first plate member 202 and the second plate member 212) are described as being included in the closure chassis coupling device 200, the closure chassis coupling device 200 may include only one plate member (e.g., the first plate member 202) and the plate securing element 208*a* and the plate securing element 208*b* may couple to each other to secure the first plate member 202 to the container closure. In other words, the first plate member 202 and the second plate member 212 may be combined as single plate member. However, in other embodiments, there may be more than two plate members that are connectible to securing the chassis coupling device 200 to the container closure While a specific closure chassis coupling device 200 has been illustrated and described, one of skill in the art in possession of the present disclosure will recognize that the closure chassis coupling device 200 of the present disclosure may include a variety of components and component configurations while remaining within the scope of the present disclosure as well.

Figure 3A:
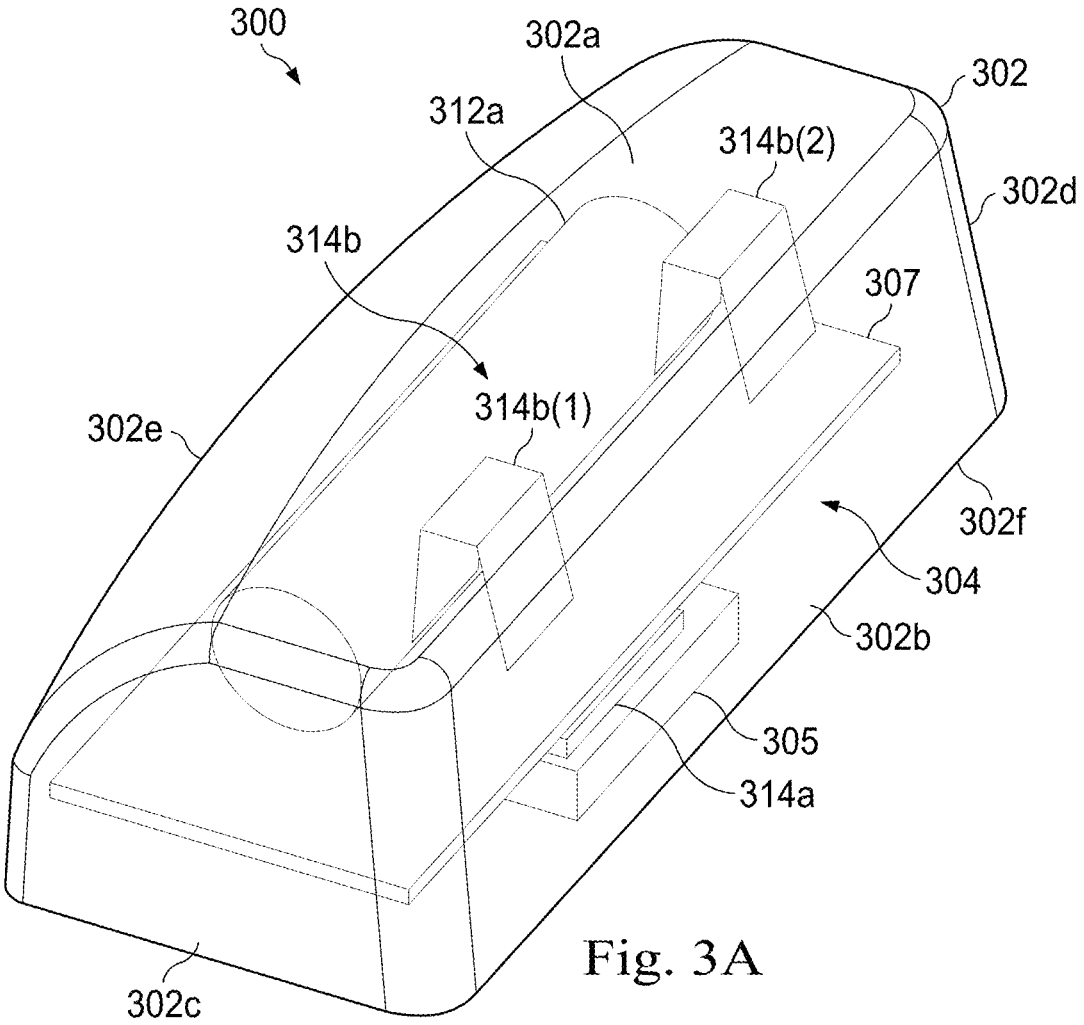
FIG. 3A is a perspective view illustrating an embodiment of a node device included in the container closure node system of FIGS. 1A and 1B.
Figure 3B:
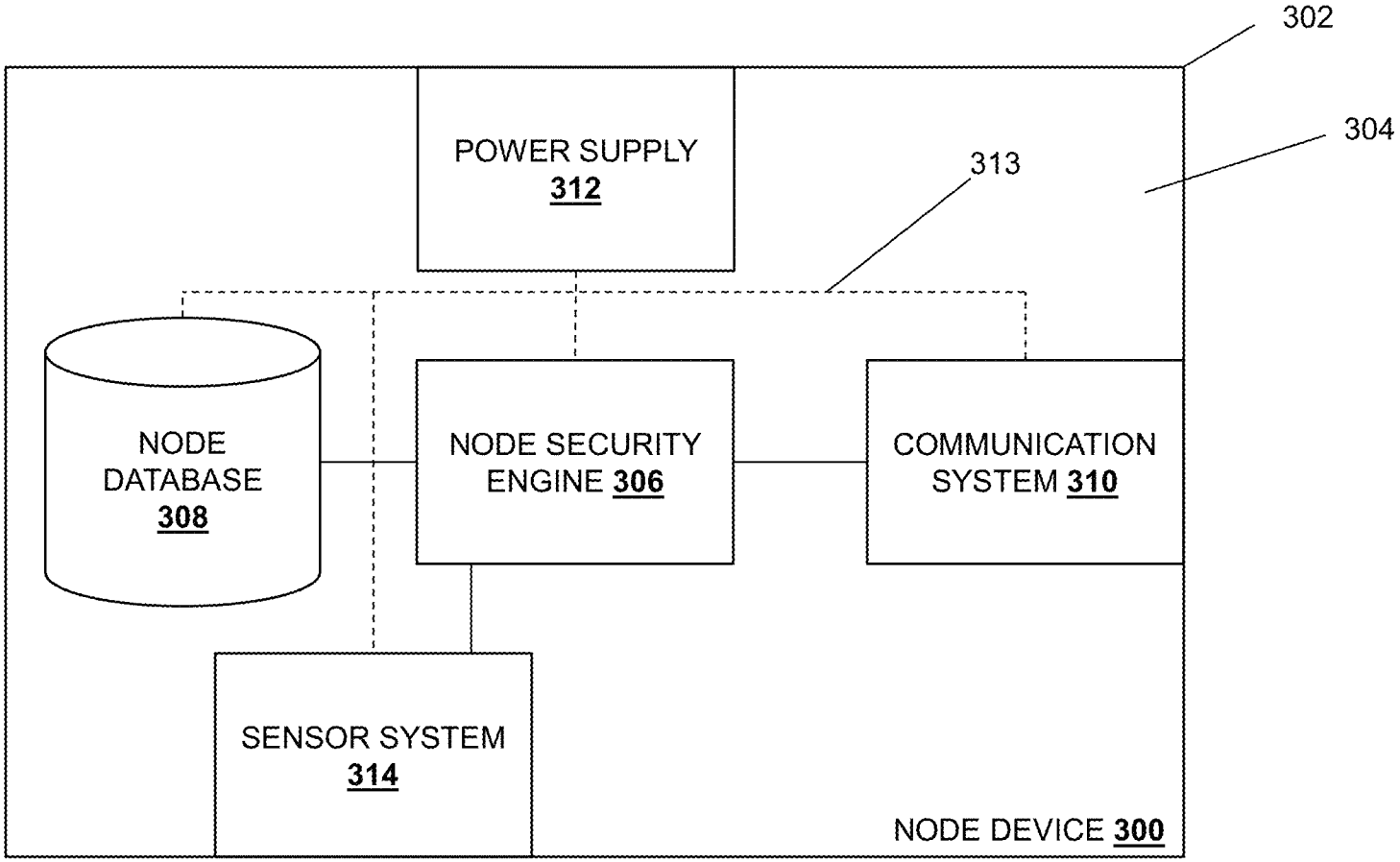
FIG. 3B is a schematic view illustrating an embodiment of the node device included in the container closure node system of FIGS. 1A and 1B.

Referring now to FIGS. 3A and 3B, an embodiment of a node device 300 is illustrated that may provide the node device 126 included in the container closure node system 122 discussed above with reference to FIG. 1. The node device 300 includes a node chassis 302 that includes a top wall 302*a*, a bottom wall 302*b* that is located opposite the node chassis 302 from the top wall 302*a*, and a pair of side walls 302*c* and 302*d* that are located opposite the node chassis 302 from each other and that extend between the top wall 302*a* and the bottom wall 104*b*. The node chassis 302 may include a front wall 302*e* that extends between the top wall 302*a*, the bottom wall 302*b*, and the side walls 302*c* and 302*d*, and a rear wall 302*f* that that is located opposite the node chassis 302 from the front wall 302*e* and that extends between the top wall 302*a*, the bottom wall 302*b*, and the side walls 302*c* and 302*d*. A node volume 304 is defined by the node chassis 302 by the top wall 302*a*, the bottom wall 302*b*, the side walls 302*c* and 302*d*, the front wall 302*e*, and the rear wall 302*f*. In the illustrated embodiment, the top wall 302*a*, the bottom wall 302*b*, the side walls 302*c* and 302*d*, the front wall 302*e*, and/or the rear wall 302*f* may define a component access aperture (not illustrated) that may be used to access any node components housed in the node volume 304.

In various embodiments, the node chassis 302 may include a closure chassis coupling device securing element 305 that may be configured to engage the node securing element 222 on the closure chassis coupling device 200 of FIG. 2 to couple the closure chassis coupling device 200 to the node device 300. For example, the closure chassis coupling device securing element 305 may engage the node securing element engagement member 222*a* and/or the node securing element engagement member 222*b* of FIG. 2 when the plate securing elements 208*a* and 218*a* are engaged and the plate securing elements 208*b* and 218*b* are engaged.

Furthermore, while illustrated and discussed as a node device 300, one of skill in the art in possession of the present disclosure will recognize that the functionality of the node device 300 discussed below may be provided by other devices that are configured to operate similarly as discussed below. In the illustrated embodiment, the node device 300 includes the node chassis 302 that houses the components of the node device 300 in the node volume 304, only some of which are illustrated below. For example, the node chassis 302 may house a processing system (not illustrated but may be provided by a processor) and a memory system (not illustrated but may be provided by system memory (e.g., random access memory (RAM) devices such as dynamic RAM (DRAM), synchronous DRAM (SDRAM), solid state memory devices, and/or a variety of other memory devices known in the art) that is coupled to the processing system and that includes instructions that, when executed by the processing system, cause the processing system to provide a node security engine 306 that is configured to perform the functionality of the node security engines and/or node devices discussed below. The processing system and the memory system may be provided on a circuit board 307. While a processing system and a memory system are discussed as providing the node security engine 306, the node security engine 306 may be provided by application specific integrated circuits (ASICs), field-programmable gate arrays (FPGAs), complex programmable logic devices (CPLDs) and/or any other hardware circuit that may be configured to cause a communication interface, discussed below, to provide a notification in response to a security sensor signal being generated by a security sensor.

The node chassis 302 may also house a storage system (not illustrated, but which may include mass storage devices that may include hard discs, optical disks, magneto-optical discs, solid-state storage devices, and/or a variety other mass storage devices known in the art) that is coupled to the node security engine 306 (e.g., via a coupling between the storage system and the processing system) and that includes a node database 308 that is configured to store any of the information utilized by the node security engine 306 discussed below. The node chassis 302 may also house a communication system 310 that is coupled to the node security engine 306 (e.g., via a coupling between the communication system 310 and the processing system) and that may be provided by a Network Interface Controller (NIC), wireless communication systems (e.g., BLUETOOTH®, Near Field Communication (NFC) components, WiFi components, etc.), and/or any other communication components that would be apparent to one of skill in the art in possession of the present disclosure. In a particular embodiment, the communication system 310 may include a communication interface (e.g., a relatively short-range and/or relatively low-power transceiver(s)) that is configured to provide direct communication with other devices (e.g., a corresponding communication interface in the container closure 130 of FIG. 1). For example, the communication interface may be configured to operate according to wireless protocols such as Bluetooth®, Bluetooth® Low Energy (BLE), near field communication (NFC), infrared data association (IrDA), ANT®, Zigbee®, Z-Wave®, IEEE 802.11 protocols (Wi-Fi), and/or any other wireless communication protocols that allow for the direct device communication described herein. In some embodiments, the communication system 310 may be included on the circuit board 307.

The node chassis 302 may also house a power supply system 312 that may include and/or be configured to couple to a battery 312*a*. For example, the power supply system 312 may include an integrated rechargeable battery that may be recharged in the node chassis 302 using methods known in the art, and/or may include other power sources that would be apparent to one of skill in the art in possession of the present disclosure. For example, the power supply system 312 and node chassis 302 may be configured to accept a replaceable, non-rechargeable/rechargeable battery while remaining within the scope of the present disclosure as well. The power supply system 312 may be coupled to the node security engine 306, the node database 308, the communication system 310 and/or a sensor system 314 via a power bus 313.

The node chassis 302 may also house and/or provide the sensor system 314. The sensor system 314 may include one or more security sensors that detect a security event. For sensor system 314 may include a node device movement sensor 314*a* (e.g., a Hall effect sensor or other motion sensor) that is provided adjacent the bottom wall 302*b*, included in the closure chassis coupling device securing element 305 and/or housed elsewhere in node chassis 302 such that the node device movement sensor 314*a* can detect when the node device 300 has moved relative to the container 102. For example, the node device movement sensor 314*a* may include a Hall effect sensor that can detect a magnetic field provided by a magnet coupled to and/or embedded in the top wall 104*a* of the container chassis 104 of FIG. 1 when in a first position range and provide a first signal when in that first position range. The Hall effect sensor may also detect the lack of presence of a magnetic field or a weak magnetic field when outside of the first position range and generate a second signal (e.g., a security signal indicating that the node device 300 has moved relative to the magnet indicating that that the container closure node system 122 and/or the container closure 110 of FIG. 1 has been moved such that the contents of the container 102 have been possibly accessed). While a Hall effect sensor is described as detecting movement of the container closure node system 122 and/or the container closure 110 relative to the container 102, one of skill in the art will recognize that the node device movement sensor 314*a* may include other sensors that may detect movement of the container closure node system 122 and/or the container closure 110 relative to the container 102.

In another example, the sensor system 314 may include other security sensors such as a seal presence sensor 314*b*. The seal presence sensor 314*b* may include a first electrical contact 314*b*(1) and a second electrical contact 314*b*(2) on the top wall 302*a* and/or other wall of the node chassis 302 that forms a closed circuit when the seal 128 of FIG. 1 is coupled to the node device 300 and that provides a first signal to the node security engine 306. The seal presence sensor 314*b* may provide a second signal (e.g., a security signal) to the node security engine 306 when the seal 128 is decoupled from the first electrical contact 314*b*(1) and/or the second electrical contact 314*b*(2) indicating that the seal 128 has been removed from the container closure 110. While specific security sensors 314*a* and 314*b* have been described as being included in the sensor system 314, one of skill in the art in possession of the present disclosure will recognize that other security sensors or information sensors may be included in the sensor system 314. For example, the sensor system 314 may include, for example, a load sensors, a temperature sensor, a humidity sensor, a chemical agent sensor, a positioning sensor, an orientation sensor, a pressure sensor, a movement sensor (e.g., an accelerometer), a shock sensor, and/or any other sensors that would be apparent to one of skill in the art in possession of the present disclosure. While a specific node device 300 has been illustrated, one of skill in the art in possession of the present disclosure will recognize that node devices (or other devices operating according to the teachings of the present disclosure in a manner similar to that described below for the node device 300) may include a variety of components and/or component configurations for providing the functionality discussed below, while remaining within the scope of the present disclosure as well.

Figure 4:
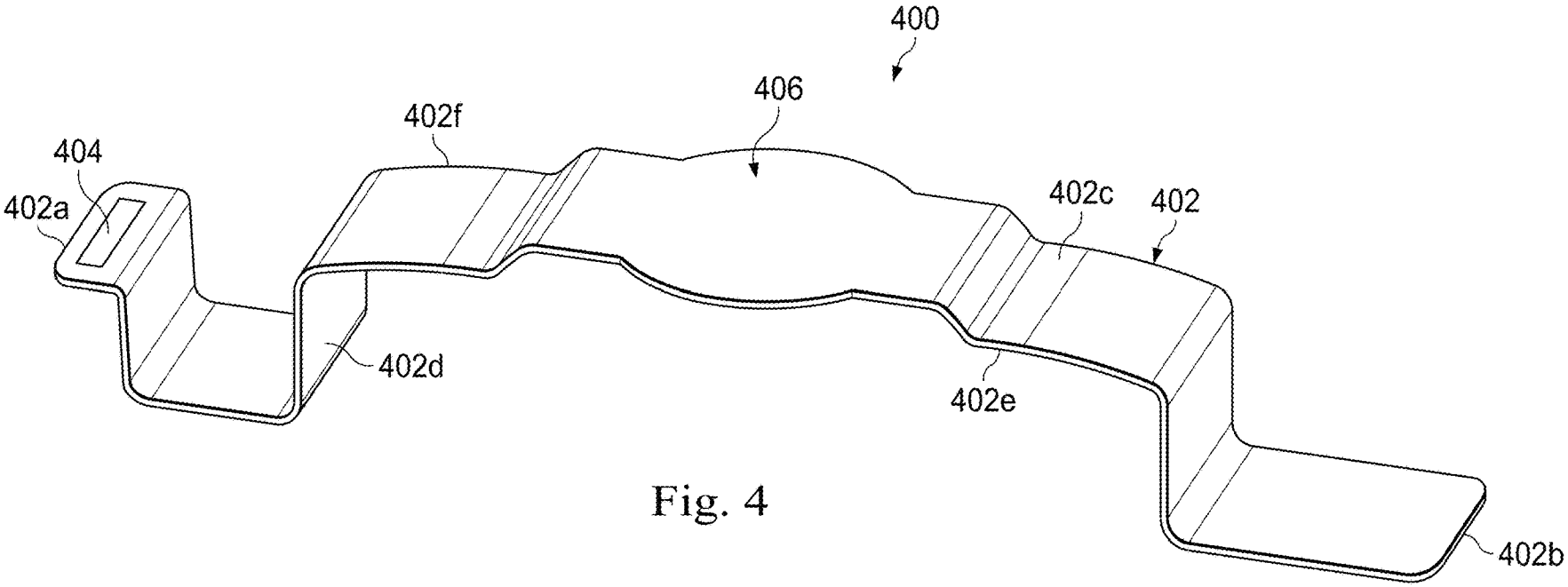
FIG. 4 is a perspective view illustrating an embodiment of a seal included in the container closure node system of FIGS. 1A and 1B.

Referring now to FIG. 4, an embodiment of a seal 400 is illustrated that may provide the seal 128 included in the container closure node system 122 discussed above with reference to FIG. 1. The seal 400 may include a closure conforming member 402. The closure conforming member 402 may include a first end 402*a* and a second end 402*b* that is opposite the closure conforming member 402 from the first end 402*a*. The closure conforming member 402 may also include a first surface 402*c* and a second surface 402*d* that is opposite the closure conforming member 402 from the first surface 402*c* and the first surface 402*c* and the second surface 402*d* extend between the first end 402*a* and the second end 402*b*. The closure conforming member 402 may also include a first edge 402*e* that extends between the first surface 402*c*, the second surface 402*d*, the first end 402*a*, and the second end 402*b*, and a second edge 402*f* that is opposite the closure conforming member 402 from the first edge 402*e* and that extends between the first surface 402*c*, the second surface 402*d*, the first end 402*a*, and the second end 402*b*. The closure conforming member 402 may conform to the shape of the container closure 110 and may be configured to cover a portion of the container closure chassis top wall 112*a* of the container closure 110 of FIG. 1. Specifically, the closure conforming member may cover at least a portion of the secondary container closure 121.

The first end 402*a* on the second surface 402*d* may include a contact plate 404 that is configured to close a circuit with the first electrical contact 314*b*(1) and the second electrical contact 314*b*(2) on the seal presence sensor 314*b* of FIG. 3. In an embodiment, at least a portion of the second surface 402*d* of the closure conforming member 402 may include an adhesive to adhere the closure conforming member 402 to the container closure 110 or the closure conforming member 402 may be configured to provide a resistive coupling when engaged with the container closure 110.

In various embodiments, the seal 400 may include a communication interface 406 that is associated with a seal identifier. For example, the communication interface may include an RFID tag that may store a seal identifier that may be associated with the container 102, the container closure 110, and/or the container closure node system 122 and/or identifiers for the container 102, the container closure 110, and/or the container closure node system 122. In another example, the communication interface 406 may include an NFC tag in the seal that may store the seal identifier. While a specific seal 400 has been illustrated, one of skill in the art in possession of the present disclosure will recognize that seals (or other devices operating according to the teachings of the present disclosure in a manner similar to that described below for the seal 400) may include a variety of components and/or component configurations for providing the functionality discussed below, while remaining within the scope of the present disclosure as well.

Figure 5:
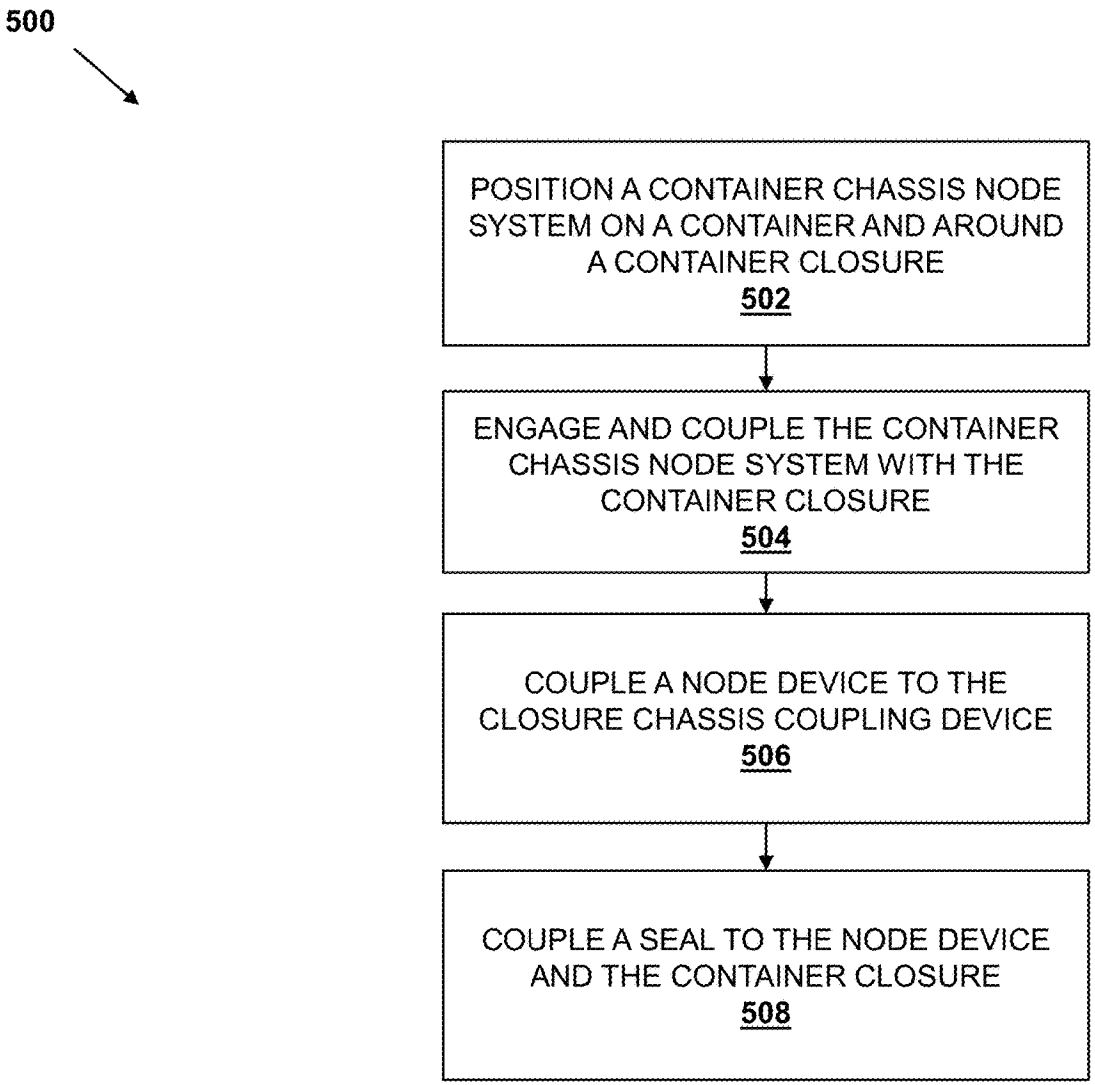
FIG. 5 is a flow chart illustrating an embodiment of a method of coupling a container closure node system to a container closure.

Referring now to FIG. 5, a method 500 for coupling a container closure node system is illustrated. As discussed above, the systems and methods of the present disclosure provide a container closure with the container closure node system that is relatively easy to add and remove from the container closure coupled to a container during a container lifecycle. The container closure node system also maintains a low profile relative to the container closure such that conventional tools for removing the container closure or accessing the container closure may be used. The container closure node system may provide a security node for the container and the container closure that can detect and report security events (e.g., when the container closure was opened, changes in temperature, etc.) during the container lifecycle. The container closure node system may include a first plate member and a second plate member that include plate securing elements on each end of the first plate member and the second plate member. The first plate member and the second plate member may be position on closure chassis side walls of a container closure and the plate securing elements may be engaged such that the container closure node system cannot rotationally move with respect to the container closure (e.g., the container closure node system moves with the container closure). A node device may be coupled to a node securing element on the first plate member and/or the second plate member and may include a sensor that detects when the node device moves relative to the container indicating that the container closure node system has been removed and/or the container closure has been removed from the container. Additionally, a seal that conforms to the container closure may be positioned over the container closure and coupled with a seal presence sensor on the node device. However, while specific components and component configurations for the container closure node system are illustrate and described below, a wide variety of component and component configurations are envisioned as falling within the scope of the present disclosure as well.

Figure 6A:
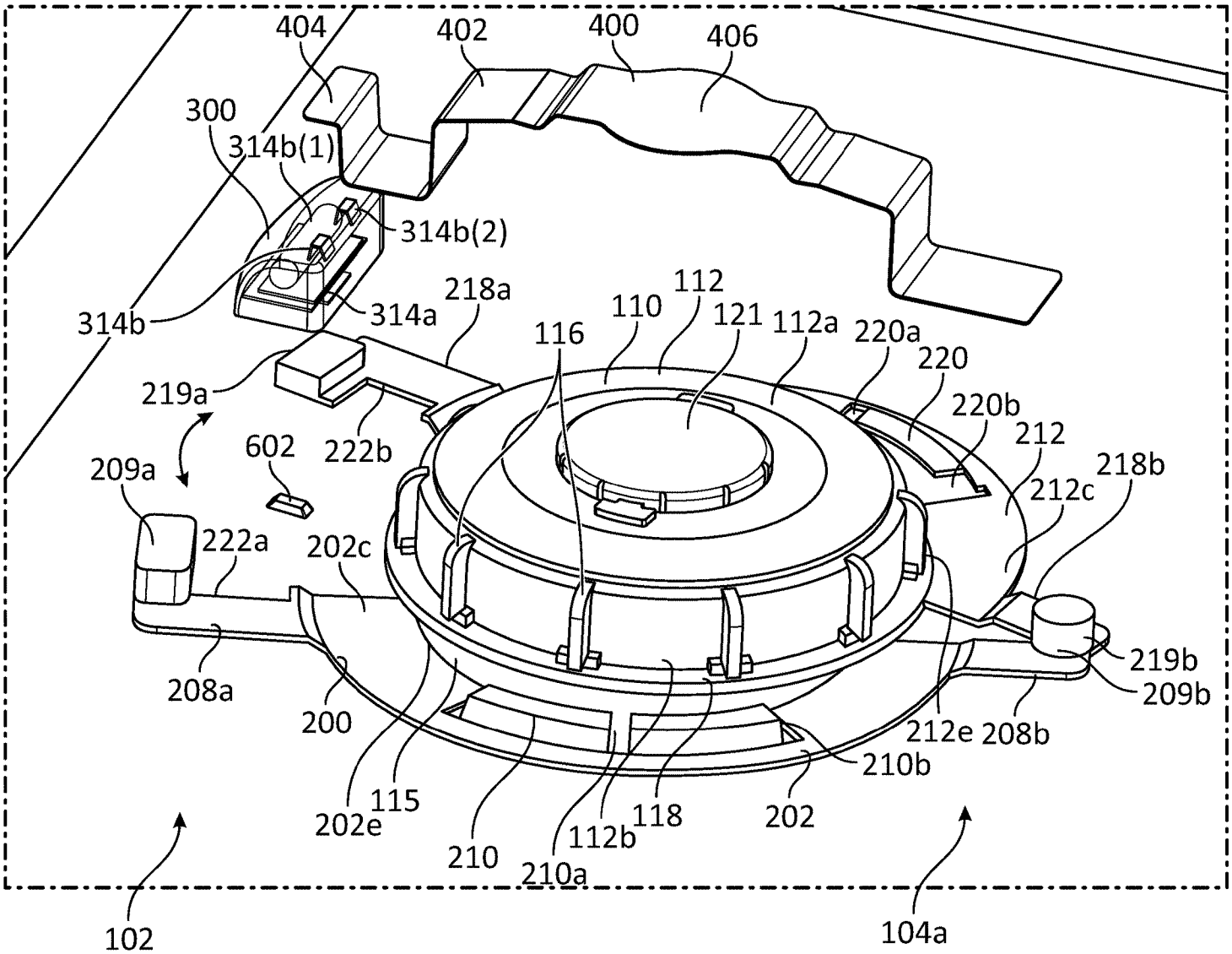
FIG. 6A is a perspective view illustrating an embodiment of the container closure node system being secured to the container closure during the method of FIG. 5.

The method 500 begins at block 502 where a container closure node system is positioned on a container and around a container closure. In an embodiment, at block 502 and with reference to FIG. 6A, the container closure node system 122 may be positioned on the container 102 (e.g., the top wall 104*a*) and around the container closure 110. As illustrated in FIG. 6A, the securing element engagement member 209*b* included on the first plate member 202 and the securing element engagement member 219*b* included on the second plate member 212 may be engaged prior to block 502 and may be pivotally coupled (e.g., form a hinge) such that the closure chassis coupling device 200 may be in an open orientation when the securing element engagement member 209*a* and the securing element engagement member 219*a* are disengaged. While in the open position, the container closure node system 122 may be positioned on the container 102 and around the container closure 110.

The method 500 then proceeds to block 504 where the container closure node system is engaged and coupled with the container closure. In an embodiment, at block 504 and with reference to FIGS. 6A, 6B, and 6C, the securing element engagement member 209*a* may be engaged and coupled to the securing element engagement member 219*a*. In some embodiments where the securing element engagement member 209*b* are not engaged and coupled to the securing element engagement member 219*b* prior to block 502, the securing element engagement member 209*b* may be engaged and coupled to the securing element engagement member 219*b*. As a result, the first edge 202*e* of the first plate member 202 and the first edge 212*e* of the second plate member 212 may be positioned in the space 115 such that a portion of the first plate member 202 and the second plate member 212 is between the container closure 110 and the container 102. The closure chassis coupling device 200 may be in the closed orientation.

In various embodiments, the container closure chassis securing element 210 and/or the container closure chassis securing element 220 may engage and secure the closure chassis coupling device 200 to the container closure 110. For example, the one or more slots 210*a* on the container closure chassis securing element 210 may receive one or more of the protrusions 116 included on the container closure 110. Similarly, the one or more slots 220*a* on the container closure chassis securing element 220 may receive one or more of the protrusions 116 included on the container closure 110. Furthermore, the closure lip slot 210*b* defined by container closure chassis securing element 210 and the first surface 202*c* may receive the closure lip 118 included on the container closure 110, and the closure lip slot 220*b* defined by container closure chassis securing element 220 and the first surface 212*c* may receive the closure lip 118 included on the container closure 110.

Figure 6B:
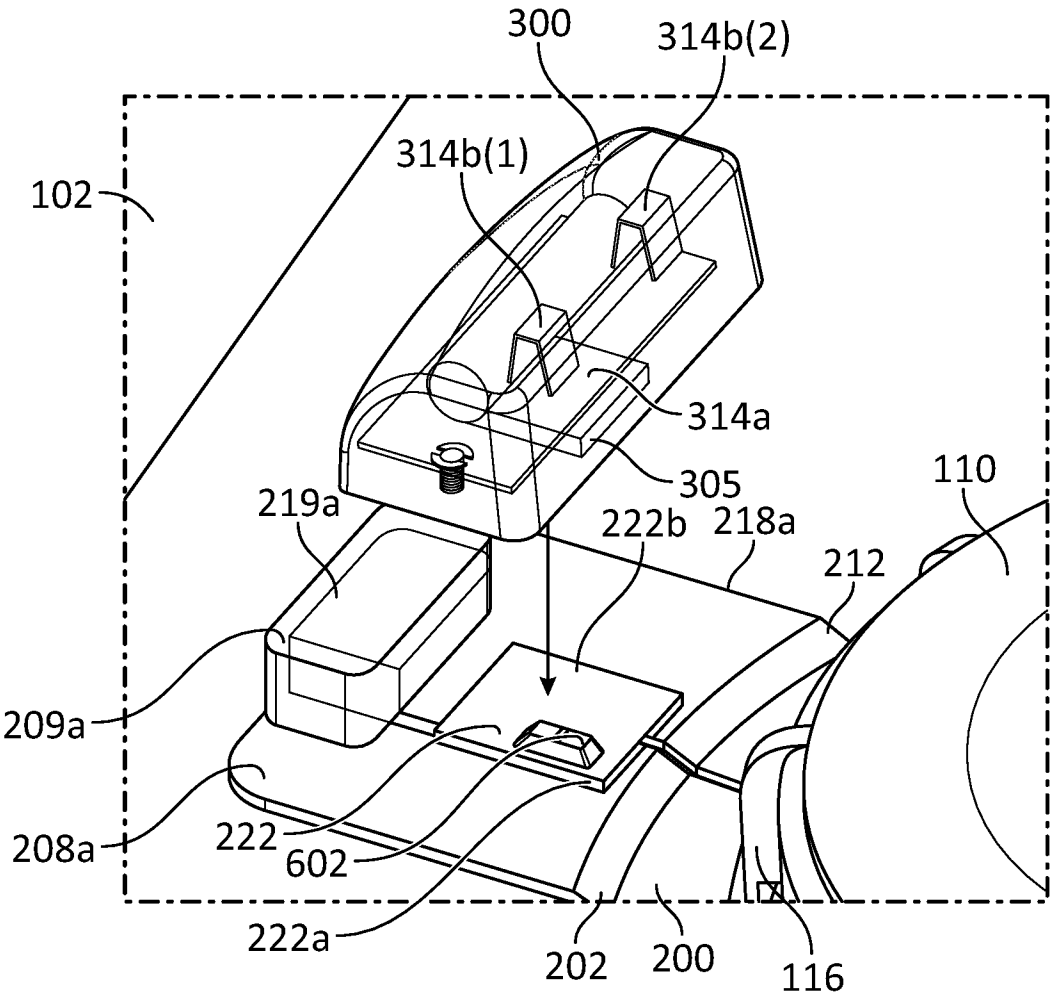
FIG. 6B is a perspective view illustrating an embodiment of the node device of FIGS. 3A and 3B being secured to the closure chassis coupling device of FIG. 2 during the method of FIG. 5.
Figure 6C:
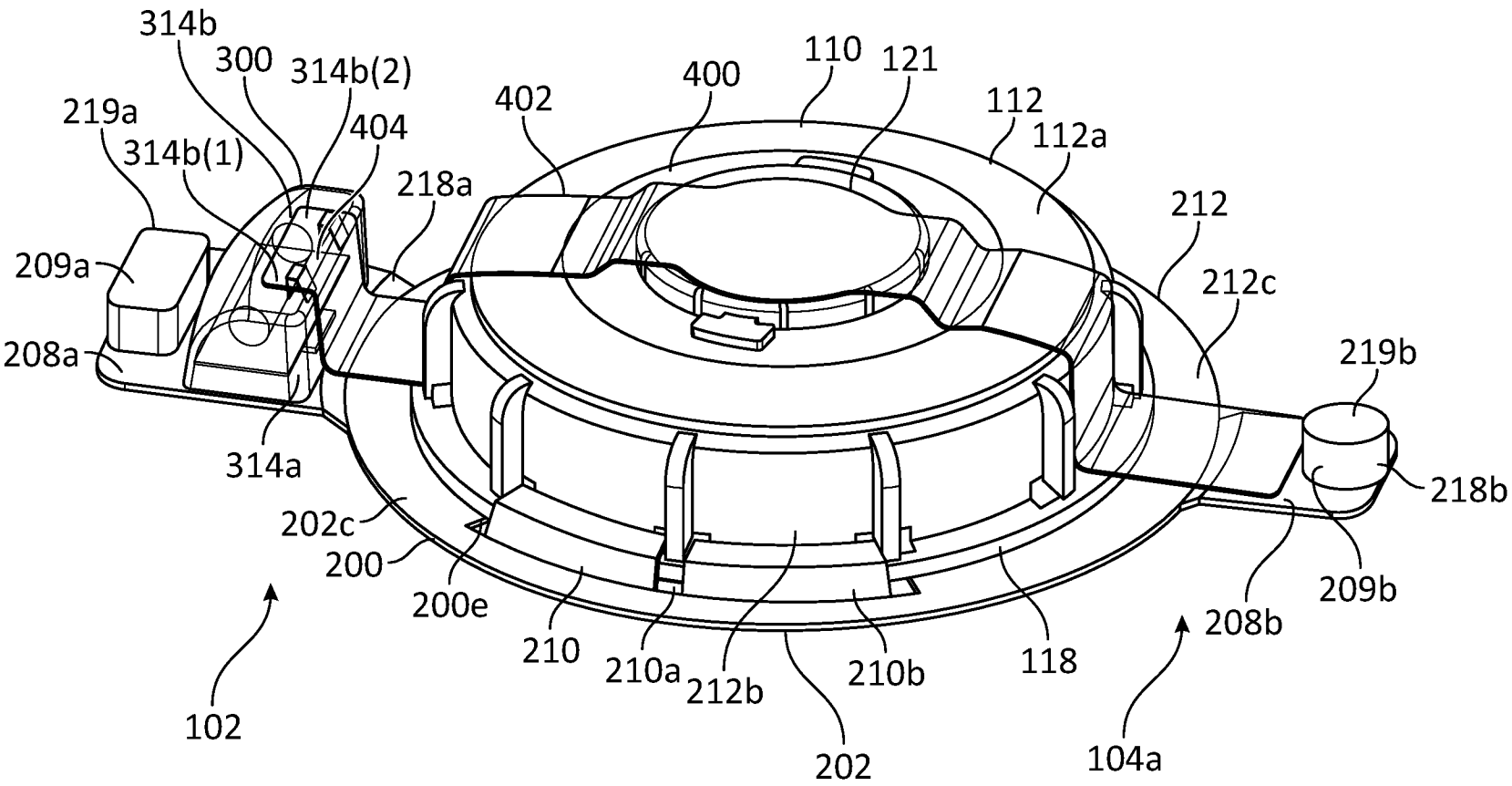
FIG. 6C is a perspective view illustrating an embodiment of the seal of FIG. 4 being secured to the container closure and the node device during the method of FIG. 5.

The method 500 may then proceed to block 506 where the node device is coupled to the closure chassis coupling device. In an embodiment, at block 506 and with reference to FIGS. 6A, 6B, and 6C, the node device 300 may be coupled to the closure chassis coupling device 200. In an embodiment the node device 300 may be coupled to the closure chassis coupling device 200 prior to the closure chassis coupling device 200 being coupled to the container closure 110. However, in other embodiments and as illustrated in FIGS. 6A, 6B, and 6C the node device 300 may be coupled to the closure chassis coupling device 200 during or after the closure chassis coupling device 200 being coupled to the container closure 110. For example, the closure chassis coupling device securing element 305 that may be configured to engage the node securing element 222 on the closure chassis coupling device 200. In a specific example, the closure chassis coupling device securing element 305 may engage the node securing element engagement member 222*a* and/or the node securing element engagement member 222*b* when the plate securing elements 208*a* and 218*a* are engaged and the plate securing elements 208*b* and 218*b* are engaged. The node device 300 may be positioned over a magnet 602 that is coupled to the container 102 such that the node device movement sensor 314*a* is aligned with the magnet 602.

The method 500 may then proceed to block 508 where a seal is coupled to the node device and the container closure. In an embodiment, at block 508 and with reference to FIGS. 6A-6C, the seal 400 may be coupled to the container closure 110 and the container closure node system 122. The closure conforming member 402 may be frictionally and/or adhesively secured to the container closure 110. The contact plate 404 may be coupled with the seal presence sensor 314*b* such that the contact plate 404 is in electrical contact with the first electrical contact 314*b*(1) and the second electrical contact 314*b*(2). In the illustrated embodiment, the seal 400 may positioned over the secondary container closure 121 that covers the container closure chassis aperture 120 such that the seal 400 has to be removed before the secondary container closure 121 can be removed to access the container closure chassis aperture 120.

In various embodiments of method 500, after the container closure node system 122 is assembled and coupled to the container closure, a user may decouple the container closure node system 122 from the container closure 110. For example, the user may remove the seal 400 which will cause the seal presences sensor 314*b* to generate a security signal, discussed below. The user may also detach the closure chassis coupling device 200 by, for example, activating a securing element release member that disengages the securing element engagement member 209*a* and the securing element engagement member 219*a* to cause the closure chassis coupling device 200 to be in the open orientation. The node device movement sensor 314*a* may generate a security signal when the closure chassis coupling device 200 transitions to the open orientation.

Figure 7:
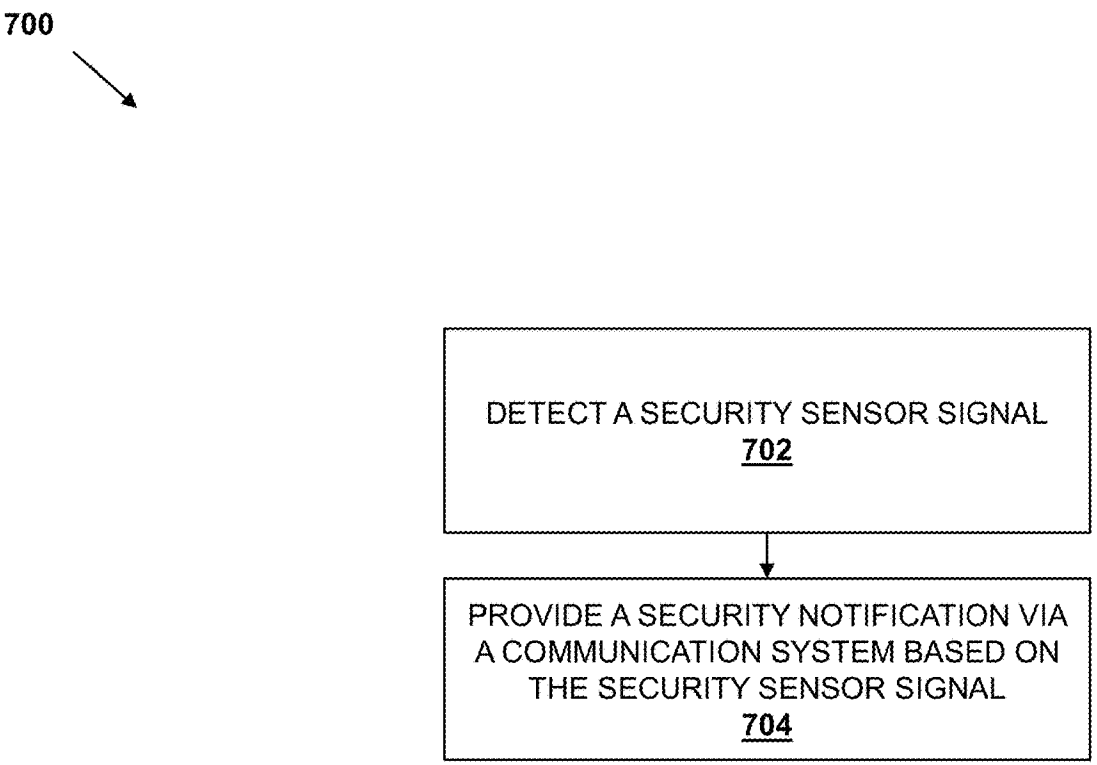
FIG. 7 is a flow chart illustrating an embodiment of a method for providing container security.

Referring now to FIG. 7, a method 700 for providing container security is illustrated. The method 700 may begin at block 702 where the node device detects a security sensor signal. In an embodiment of block 702, the node security engine 306 may detect a security sensor signal indicating a tamper event has occurred. For example, the node security engine 306 may detect a seal sensor signal provided by the seal presence sensor 314*b* when the seal 400 has been removed from the container closure 110 and/or at the very least when the contact plate 404 is no longer in contact with the first electrical contact 314*b*(1) and/or the second electrical contact 314*b*(2) on the seal presence sensor 314*b*. In another example, the node security engine 306 may detect a sensor signal provided by the node device movement sensor 314*a* that may indicate that the container closure 110 and/or the container closure node system 122 has moved relative to the container 102. For example, if the container closure 110 is unscrewed, the closure chassis coupling device 200 rotationally moves with the container closure 110 such that the node device movement sensor 314*a* detects movement of the node device 300 that is coupled to the closure chassis coupling device 200. For example, the node device movement sensor 314*a* may no longer detect a magnetic field generated by the magnet 602 and/or may detect a magnetic field that is below a magnetic field threshold. In other examples, the security sensor signal may be provided by the node device movement sensor 314*a* when the closure chassis coupling device 200 has been removed from the container closure 110 (e.g., the closure chassis coupling device 200 transitions from the closed orientation to the open orientation) or when the node device 300 is decoupled from the closure chassis coupling device 200. While specific sensor signals are discussed, one skill in the art in possession of the present disclosure will recognize that other sensors that may be included in the node device 300 may provide a sensor signal to the node security engine 306 while still falling within the scope of the present disclosure. For example, an accelerometer may detect a sudden movement, a gyroscope may indicate improper orientation, a temperature sensor may indicate an unsatisfactory temperature, and/or other sensors discussed above that may provide a security sensor signal to the node security engine 306. In various embodiments, the security sensor signal and/or the seal sensor signal may include identifier(s) that are associated with the seal 400, the closure chassis coupling device 200, the node device 300, the container 102, the container closure 110, and/or any other component included in the container system 100.

The method 700 may then proceed to block 704 where a notification is provided via a communication system based on the security sensor signal in response to detecting the security sensor signal by the node device. In an embodiment of block 704, a security sensor signal may cause the node security engine 306 to generate a notification that is communicated over the communication system 310 that may be provided to a corresponding communication interface of on a container module included in the container closure 130. However, in other embodiments, the communication interface of the communication interface the communication system 310 may provide the notification to a user device that is within range of the communication interface included in the communication system 310. In other embodiments, the security engine 242 may store the notification in the node database 308 until the communication system 310 is within range of a device/communication interface with which the communication system 310 can communicate or according to any of the disclosure described in the U.S. Pat. No. 10,538,371 and that are described in U.S. patent application Ser. No. 16/451,879, filed on Jun. 25, 2019, entitled "Container Security System." In various embodiments, the notification may include the identifier(s) that are associated with the seal 400, the closure chassis coupling device 200, the node device 300, the container 102, the container closure 110, and/or any other component included in the container system 100.

Thus, systems and methods have been described that provide for a container closure node system, attachment/release of the container closure node system from a container closure, and the detection and notification of security events. The container closure node system may include a first plate member and a second plate member that include plate securing elements on each end of the first plate member and the second plate member. The first plate member and the second plate member may be positioned on the side walls of the container closure and the plate securing elements may be engaged such that the container closure node system cannot rotationally move with respect to the container closure (e.g., the container closure node system rotationally moves with the container closure). A release member may be included on the plate securing elements to enable a quick release of the plate securing elements to quickly decouple the container closure node system from a container closure. A node device may be coupled to a node securing element on the first plate member and/or the second plate member and may include a node device movement sensor (e.g., a Hall effect sensor and magnet) that detects movement of the node device relative to the container. Additionally, a seal that conforms to the container closure may be positioned over the container closure and coupled with a seal presence sensor on the node device. As such, the systems and method of the present disclosure provide a container closure with the container closure node system that is relatively easy to add and remove from the container closure coupled to the container during a container lifecycle. The container closure node system also maintains a low profile relative to the container closure such that conventional tools for removing the container closure or accessing the container closure can be used. The container closure node system may provide a security node for the container and the container closure that can detect and report security events during the container lifecycle (e.g., when the container closure was opened, closed, changes in temperature, etc.).

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed:

1. A container system, comprising:

a container that includes a container chassis that defines a container volume and a first aperture;

a container closure coupled to the container chassis, and that includes a closure chassis that is configured, when coupled to the container chassis, to prevent movement of a material between the container volume and an exterior of the container chassis via the first aperture; and a container closure node system, wherein the container closure node system comprises:

a closure chassis coupling device that couples the container closure node system to the closure chassis and that includes:

a first plate member that includes a first plate securing element and a second plate securing element; and a second plate member that includes a third plate securing element that is coupled to the first plate securing element and a fourth plate securing element that is coupled to the second plate securing element, wherein at least one of the first plate member and the second plate member comprises one or more slots configured to engage one or more protrusions of the closure chassis to prevent rotational movement of the closure chassis coupling device relative to the closure chassis when the first plate securing element is coupled with the third plate securing element and the second plate securing element is coupled with the fourth plate securing element, wherein the first plate securing element and the third plate securing element are pivotally coupled with each other, and wherein at least one of the first plate member and the second plate member comprises a tab configured to receive a lip on an edge of the closure chassis to further limit movement of the closure chassis coupling device relative to the closure chassis.

2. The container system of claim 1, wherein at least one of the first plate member or the second plate member include a plurality of sub-plate members couple to each other.

3. The container system of claim 1, wherein the second plate securing element and the fourth plate securing element include a securing element release member that is configured to release the coupling of the second plate securing element and the fourth plate securing element.

4. The container system of claim 1, wherein the closure chassis defines a closure chassis aperture that provides access to the first aperture, and wherein the closure chassis coupling device defines a closure chassis coupling device aperture that provides access to the closure chassis aperture when the closure chassis coupling device couples the container closure node system to the closure chassis.

5. The container system of claim 1, wherein the closure chassis coupling device defines closure chassis coupling device aperture that provides access to at least a portion of a container closure chassis side wall.

6. The container system of claim 1, wherein the container closure node system includes a node device that is coupled to at least one of the first plate member and the second plate member.

7. The container system of claim 6, wherein the closure chassis coupling device and the node device, when the node device is coupled to the closure chassis coupling, are configured to define a gap between the node device and a container closure chassis side wall included on the closure chassis.

8. The container system of claim 6, wherein the node device, comprises:

a power source;

at least one sensor coupled to the power source;

a communication system coupled to the power source;

a processing system coupled to the power source, the at least one sensor, and the communication system; and a memory system that is coupled to the processing system and that includes instruction, that when executed by the processing system, causes the processing system to provide a security engine that is configured to:

detect, via the at least one sensor, when a security event has occurred; and provide, via the communication system, a security event notification.

9. The container system of claim 8, further comprising:

a magnet that is coupled to container chassis, wherein the at least one sensor includes a Hall effect sensor, and wherein the Hall effect sensor is aligned with the magnet when the closure chassis coupling device couples the container closure node system to the closure chassis.

10. The container system of claim 6, wherein the closure chassis defines a closure chassis aperture that provides access to the first aperture, wherein the closure chassis coupling device defines a closure chassis coupling device aperture that provides access to the closure chassis aperture when the closure chassis coupling device couples the container closure node system to the closure chassis, and wherein the container closure node system includes a seal that covers at least a portion of the closure chassis aperture and that couples to at least a sensor included on the node device that detects at least one of a presence of the seal and a lack of presences of the seal.

11. The container system of claim 10, wherein the seal includes a communication interface that is configured to store an identifier associated with the seal, and provide the identifier when the communication interface is activated.

12. A container closure node system, comprising:

a closure chassis coupling device that is configured to couple to a closure chassis for a container aperture and that includes:

a first plate member that includes a first plate securing element and a second plate securing element; and a second plate member that includes a third plate securing element that is configured to couple to the first plate securing element and a fourth plate securing element that is configured to couple to the second plate securing element, wherein at least one of the first plate member and the second plate member comprises one or more slots configured to engage one or more protrusions of the closure chassis to prevent rotational movement of the closure chassis coupling device relative to the closure chassis when the first plate securing element is coupled with the third plate securing element and the second plate securing element is coupled with the fourth plate securing element, wherein the first plate securing element and the third plate securing element are pivotally coupled to each other, and wherein at least one of the first plate member and the second plate member comprises a tab configured to receive a lip on an edge of the closure chassis to further limit movement of the closure chassis coupling device relative to the closure chassis.

13. The container closure node system of claim 12, wherein the second plate securing element and the fourth plate securing element include a release mechanism that is configured to release the coupling of the second plate securing element and the fourth plate securing element.

14. The container closure node system of claim 12, wherein the closure chassis coupling device defines a closure chassis coupling device aperture that is configured to provide access to a closure chassis aperture and access to at least a portion of a container closure chassis side wall when the closure chassis coupling device is coupled the closure chassis.

15. The container closure node system of claim 12, further comprising:

a node device that is coupled to at least one of the first plate member and the second plate member such that a portion of the at least one of the first plate member and the second plate member is exposed between a first edge of the at least one of the first plate member and the second plate member that is opposite the at least one of the first plate member and the second plate member from a second edge that is coupled to the node device.

16. The container closure node system of claim 15, wherein the node device, comprises:

a power source;

at least one sensor coupled to the power source;

a communication system coupled to the power source;

a processing system coupled to the power source, the at least one sensor, and the communication system; and a memory system that is coupled to the processing system and that includes instruction, that when executed by the processing system, causes the processing system to provide a security engine that is configured to:

detect, via the at least one sensor, when a security event has occurred; and provide, via the communication system, a security event notification.

17. The container closure node system of claim 15, further comprising:

a seal that is coupled to a first sensor of the at least one sensor included on the node device that detects at least one of a presence of the seal and a lack of presence of the seal.

18. A method of coupling a container closure node system to a container closure, comprising:

positioning a container closure coupling device around a container closure, wherein the container closure coupling device comprises:

a first plate member that includes a first securing element engagement member and a second securing element engagement member, and a second plate member that includes a third securing element engagement member and a fourth securing element engagement member, wherein the first securing element engagement member and the third securing element engagement member are pivotally coupled with each other;

engaging the second securing element engagement member with the fourth securing element engagement member such that a container closure chassis securing element located on the first plate member couples the container closure coupling device to the container closure, wherein the container closure chassis securing element comprises one or more slots configured to engage one or more protrusions of the container closure, and wherein the container closure chassis securing element comprises a tab configured to receive a lip on an edge of the container closure; and preventing, by the container closure chassis securing element, rotational movement of the closure chassis coupling device relative to the container closure.

19. The method of claim 18, further comprising:

coupling, via a node device securing element on the first plate member, a node device that includes:

a power source;

at least one sensor coupled to the power source;

a communication system coupled to the power source;

a processing system coupled to the power source, the at least one sensor, and the communication system; and a memory system that is coupled to the processing system and that includes instruction, that when executed by the processing system, causes the processing system to provide a security engine that is configured to:

detect, via the at least one sensor, when a security event has occurred; and provide, via the communication system, a security event notification.

* * * * *